US006041464A

United States Patent [19]

Ebersole

[11] Patent Number: 6,041,464

[45] Date of Patent: Mar. 28, 2000

[54] SPRING LOADED SKID PLATE KIT FOR A STREET SWEEPER

[76] Inventor: William K. Ebersole, 6085 Mica Way, Granite Bay, Calif. 95746

[21] Appl. No.: 09/020,031

[22] Filed: Feb. 6, 1998

Related U.S. Application Data

[60] Provisional application No. 60/039,324, Feb. 7, 1997.

[51] Int. Cl.[7] ..... E01H 1/04

[52] U.S. Cl. ..... 15/83; 15/82; 15/246

[58] Field of Search ..... 15/78, 82, 83, 15/50.3, 246

[56] References Cited

U.S. PATENT DOCUMENTS

| | | | |
|---|---|---|---|
| 4,872,233 | 10/1989 | Brown | 15/83 |
| 4,951,342 | 8/1990 | Wilson | 15/83 |
| 5,940,919 | 8/1999 | Van Der Linden | 15/83 |

*Primary Examiner*—Randall E. Chin
*Attorney, Agent, or Firm*—Heisler & Associates

[57] ABSTRACT

A kit for resiliently attaching a skid plate 10 to a street sweeper S is provided. The skid plate 10 is oriented within a track T between vertical rails R of the street sweeper S. The skid plate 10 is maintained adjacent the track T by a flex bar 40 extending between the rails R and adjacent an outer surface 12 of the skid plate 10. A retainer 60 is mounted to one of the rails R and provides a flex plate 80 which is located adjacent the skid plate 10 and resists skid plate 10 lateral motion away from the sweeper S. The flex bar 40 and retainer 60 are not rigidly mounted to the rails R, but rather are mounted with springs 54, 93, 98 interposed there between to provide for resilient connection between the flex bar 40 and the sweeper S and between the retainer 60 and the sweeper S. When lateral forces are exerted on the skid plate 10, the springs 54, 93, 98 can be compressed and allow the skid plate 10 to be deflected away from the sweeper S without substantial bending of the skid plate 10 being necessary. Hence, the skid plate 10 can deflect when impacting obstacles on the surface being swept without exceeding an elastic limit of materials forming the skid plate 10 and without damage being caused to the skid plate 10.

15 Claims, 5 Drawing Sheets

SPRING LOADED SKID PLATE KIT FOR A STREET SWEEPER

This application claims benefit of Provisional Application Ser. No. 60/039,324 filed Feb. 7, 1997.

FIELD OF THE INVENTION

The following invention relates to vehicles, commonly referred to as street sweepers, which include a broom mounted thereon which brushes the surface the vehicle passes over and includes a pair of skid plates which drag upon the ground adjacent the broom. More specifically, this invention relates to kits for attachment of the skid plates to the street sweeper which allow the skid plates to flex somewhat with respect to the street sweeper when the skid plates encounter obstacles which cause the skid plate to be drawn out of position with respect to the street sweeper.

BACKGROUND OF THE INVENTION

Street sweepers have long been known that include rotating brooms which sweep pavement or other surfaces to remove debris and clean the surface. Such brooms are typically mounted upon a horizontal axis oriented perpendicular to a direction of vehicle motion. The broom has bristles which impact the surface of the pavement. Many modern street sweepers not only sweep debris with the broom, but also have on-board storage adjacent the broom where debris swept by the broom can be picked up and removed for disposal.

In one common configuration, the broom is at the rear of the vehicle and directly forward of the broom is a bin into which debris is swept by the broom. For the broom to effectively sweep debris into the bin, the bin and broom must be precisely aligned with each other. To maintain this alignment, the street sweepers typically include skid plates on each lateral side of the broom which maintain broom alignment with other portions of the sweeper. Such skid plates have a drag shoe which is formed from hardened materials which allow the drag shoe to drag on the surface of the pavement being swept by the broom. The skid plates are mounted between two vertical rails of a track which allow the skid plate to move up and down, but prevent the skid plate from forward or rearward motion. The skid plates also keep debris from being deflected laterally away from the broom after being impacted by the broom and act to guide debris into the bin of the sweeper for removal.

Because the skid plate drags upon the surface being swept, the skid plate typically encounters a variety of extreme lateral forces from impacting objects such as curbs, speed bumps, pot holes, manholes, rail roads and other objects. Prior art street sweepers securely attach the skid plates to the sweeper in a manner only allowing the skid plate to translate vertically up and down, but do not allow the skid plate to have any other motion relative to the sweeper. Hence, when the skid plate impacts objects while the sweeper is moving over the surface being swept, unless the objects can be deformed by the skid plate or cause only vertical forces to be applied to the skid plate, the skid plate must be deformed. If the deformation which the object causes the skid plate to encounter exceeds the elastic limit of the skid plate, the skid plate will be permanently deformed to some extent and the sweeper will no longer function according to its design.

Accordingly, a need exists for an alternative configuration for attachment of the skid plate to other portions of the sweeper. Such a configuration would allow the skid plate to be deflected away from other portions of the sweeper somewhat when objects are impacted by the skid plate, but cause the skid plate to return to its original position after forces encountered by impacting the object have ceased.

SUMMARY OF THE INVENTION

This invention provides a kit for modifying a street sweeper so that the skid plate can be deflected from its original position when objects are impacted by the skid plate and resiliently return the skid plate to its original position after such forces subside. A rigid cover typically holding the skid plate adjacent the track and between the rails of the sweeper is removed. This rigid cover is replaced with a flex bar. The flex bar extends between the rails and over the track with the skid plate oriented between the flex bar and the track. The flex bar is not rigidly mounted to the rails, but rather is mounted with bolts and with springs so that ends of the flex bar adjacent the rails can be displaced away from the rails somewhat by compression of the springs. Thus, when objects are impacted by the skid plate, causing the skid plate to be deflected laterally in a direction perpendicular to motion of the sweeper, the springs are compressed and the flex bar can move laterally with the skid plate so that the skid plate itself is not substantially deflected. When such lateral loads on the skid plate subside, the spring returns the flex bar and skid plate to their original position.

Additionally, a retainer is secured to one of the rails and provides a lateral support to prevent the skid plate from pivoting unless lateral forces are encountered by the skid plate. Once such lateral forces are experienced, the retainer includes a reference plate and a flex plate which can be flexed together, allowing the skid plate to pivot laterally. A spring is interposed between the reference plate and the flex plate to resiliently return the retainer to its original position and configuration when the forces subside. The force required to cause the flex plate of the retainer to flex is less than the force required to cause the flex bar to pivot away from the sweeper. Hence, when minor lateral forces are encountered by the skid plate, the retainer allows the skid plate to flex a small amount with the flex bar holding upper portions of the skid plate in position adjacent the track on the sweeper. When larger lateral forces are encountered by the skid plate, both the flex plate of the retainer and the flex bar can flex along with the skid plate to allow the skid plate to flex a larger amount. When such lateral forces subside, springs in the retainer and adjacent the flex bar cause the skid plate to return to its original position.

Additionally, the drag shoe on the bottom of the skid plate is provided with a rocker on both front and rear edges to allow the drag shoe to slide over objects of a low profile. The forward rocker is provided with a ski nose to further enhance the ability of the drag shoe to ride over the top of objects. The ski nose decreases the likelihood that the skid plate will catch upon an object during sweeper motion and either cause damage to the roadway being swept or damage to the sweeper.

OBJECTS OF THE INVENTION

Accordingly, a primary object of the present invention is to provide a kit for modifying the structure attaching a skid plate to a street sweeper so that the skid plate can be deflected away from the sweeper and returned to its original position when objects are encountered by the skid plate as the sweeper passes over a surface to be swept.

Another object of the present invention is to provide an attachment structure for attaching a skid plate to a street sweeper which enhances the reliability of the street sweeper and the effectiveness of the broom of the street sweeper in removing debris from a surface.

Another object of the present invention is to provide a street sweeper which avoids damage caused by impacting obstacles during the sweeping process.

Another object of the present invention is to provide a method for modifying a street sweeper so that skid plates of the street sweeper are resiliently connected to the street sweeper rather than rigidly connected to the street sweeper.

Another object of the present invention is to provide a skid plate for a street sweeper which drags upon the ground during street sweeper operation and can be deflected somewhat when objects are impacted by the skid plate without permanent deformation of the skid plate.

Another object of the present invention is to provide a skid plate with enhanced ability to slide over the top of large objects.

Another object of the present invention is to provide a kit which can easily be mounted to a street sweeper without substantial modification to the street sweeper.

Another object of the present invention is to provide a street sweeper which can respond to impacting objects sticking up from the surface to be swept without damaging the sweeper and to respond to a degree corresponding to the amount necessary to prevent damage to the sweeper, but not more than necessary.

Other further objects of the present invention will become apparent from a careful reading of the included drawing figures, the claims and detailed description of the invention.

BRIEF DESCRIPTION OF THE DRAWING FIGURES

DETAILED DESCRIPTION OF THE PREFERRED EMBODIMENT

Figure 1:
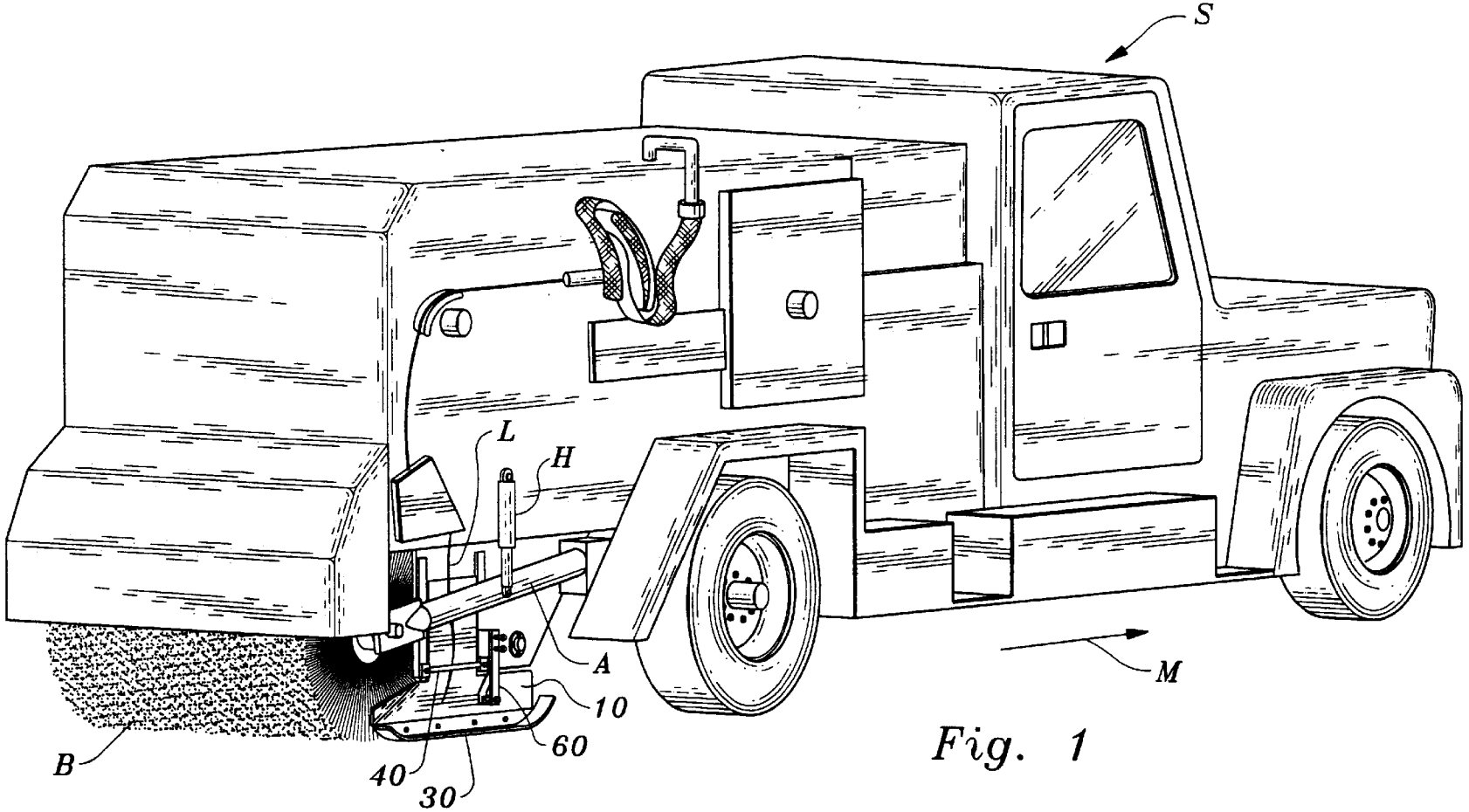
FIG. 1 is a perspective view of a street sweeper with a skid plate thereof attached utilizing the kit of this invention.

Referring to the drawings, wherein like reference numerals represent like parts throughout the various different drawing figures, reference numeral 10 is directed to a skid plate attached to a street sweeper S (FIG. 1) with a kit which allows the skid plate 10 to flex with respect to the sweeper S when obstacles are impacted by the skid plate 10. The kit includes a flex bar 40 and a retainer 60 which keep the skid plate 10 in position within a track T (FIG. 4) except when an object is impacted which causes forces to be exerted against the skid plate 10, causing the skid plate 10 to be pivoted out of position. The flex bar 40 and retainer 60 resiliently secure the skid plate 10 into position so that when the obstacle has been bypassed, the skid plate 10 is returned to its original position without permanent deformation or other damage.

In essence, and with particular reference to FIG. 1, the sweeper S, as modified by the kit of this invention, includes the following general features. The sweeper S is a vehicle adapted to travel upon a roadway or other substantially horizontal surface with a broom B appropriately positioned to sweep the surface upon which the street sweeper S is positioned. The broom B is held in position by a trailing arm A and a hydraulic ram H which position the broom B adjacent the surface. Two skid plates 10 are positioned on lateral sides of the broom B. Each skid plate 10 is restrained from motion with respect to the sweeper S except for in a vertical direction, or when obstacles are encountered applying lateral forces to the skid plate 10 as discussed below. A drag shoe 30 is attached to the skid plate 10 which drags directly adjacent the surface upon which the street sweeper S is traveling. A lifting chain L is attached to the skid plate 10 to allow the skid plate 10 to have its vertical position adjusted when desired.

An attachment kit keeps the skid plate 10 in the desired position adjacent the sweeper S. The attachment kit includes a flex bar 40 which is oriented substantially horizontally and restrains the skid plate from motion laterally (arrow N of FIGS. 4 and 7–9) in a horizontal direction perpendicular to the direction of vehicle motion (arrow M). The attachment kit also includes a retainer 60 which provides further lateral support for the skid plate 10. Both the flex bar 40 and retainer 60 include resilient connectors connecting the flex bar 40 and retainer 60 to the sweeper S. The resilient connectors, such as springs 54, 93, 98, allow the flex bar 40 and retainer 60 to flex away from the sweeper S somewhat and allow the skid plate 10 to flex away from the sweeper S somewhat when obstacles are impacted by the skid plate 10 which exert lateral forces on the skid plate 10. The resilient connectors of the flex bar 40 and retainer 60 return the skid plate 10 to its original position when the obstacle has been cleared and such lateral forces subside.

More specifically, and with particular reference to FIG. 1, details of the sweeper S to which the skid plate 10 and kit of this invention are attached, is described. The sweeper S can be any of a variety of different vehicles which are adapted to be driven upon substantially flat horizontal surfaces, such as motor vehicle roadways, streets and the like. Typical sweepers S have a cab where a driver drives the sweeper S and wheels upon which the sweeper S is driven. In addition, the sweeper S includes street sweeping equipment which includes a broom B positioned to sweep the surface upon which the sweeper S is located. The broom B has a series of bristles which extend radially away from an axle which is pivotably supported by a pair of trailing arms A. The tips of the bristles of the broom B generally form a cylinder.

The axle of the broom B is preferably oriented horizontally and perpendicular to the direction of sweeper S motion (arrow M). A hydraulic ram H attaches to the trailing arm A to allow the trailing arm A to pivot up and down and provide the broom B in position with the bristles impacting the surface upon which the sweeper S is located. The sweeper S preferably includes some form of storage bin which is adapted to receive and store debris swept up by the broom B. Typically, such a bin is oriented forward of the broom B and the broom B is rotated in a direction causing debris to be swept forward by the bristles of the broom B and into the bin, for collection within the sweeper S. The debris can then be later removed at a disposal site.

Figure 2:
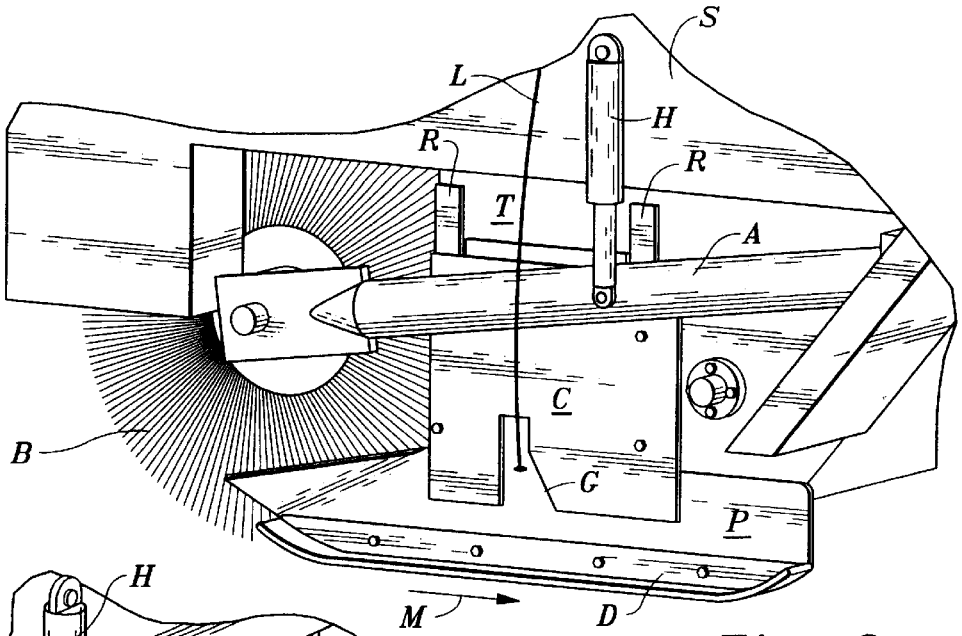
Fig. 2 (PRIOR ART)
FIG. 2 is a perspective view of a right side of a prior art sweeper with details shown of how the skid plate is mounted to the sweeper.

With continuing reference to the sweeper S and particularly prior art attachment mechanisms for prior art skid plates P, reference is primarily made to FIG. 2. Prior art sweepers S are provided with a vertically oriented track T bounded on forward and rearward edges by rails R. This support track T has a track surface which faces away from the sweeper S on either side of the sweeper S. The rails R are substantially linear and oriented vertically.

The prior art skid plate P is substantially identical to the skid plate 10 of this invention. The prior art skid plate P includes a vertical leg similar to the vertical leg 16 (FIG. 3) which has a width similar to a distance between the two rails R. The vertical leg is substantially planar and can thus slide up and down along the track T and between the rails R so that the skid plate P can have its vertical position adjusted. A lifting chain L is secured to the skid plate P to allow a position of the skid plate P to be adjusted by an operator of the sweeper S. A cover plate C is secured to the rails R and oriented parallel to the track T, but spaced on an opposite outer surface of the skid plate P. Thus, the support track T, rails R and cover plate C restrain the vertical leg of the skid plate P from any motion except for vertical motion. A groove G is formed in the cover plate C to provide clearance for the lifting chain L when the skid plate P is raised and lowered.

Figure 6:
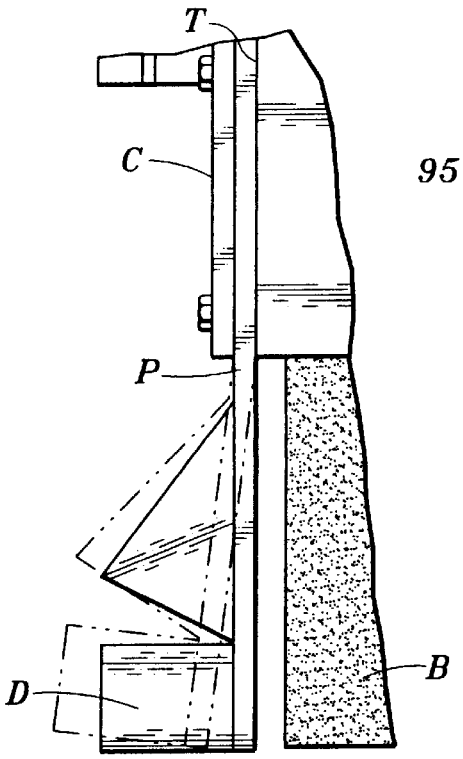
Fig. 6 (PRIOR ART)
FIG. 6 is a front view of a portion of that which is shown in FIG. 2 illustrating how the prior art skid plate is deformed when lateral forces are applied to the prior art skid plate.
Figure 10:
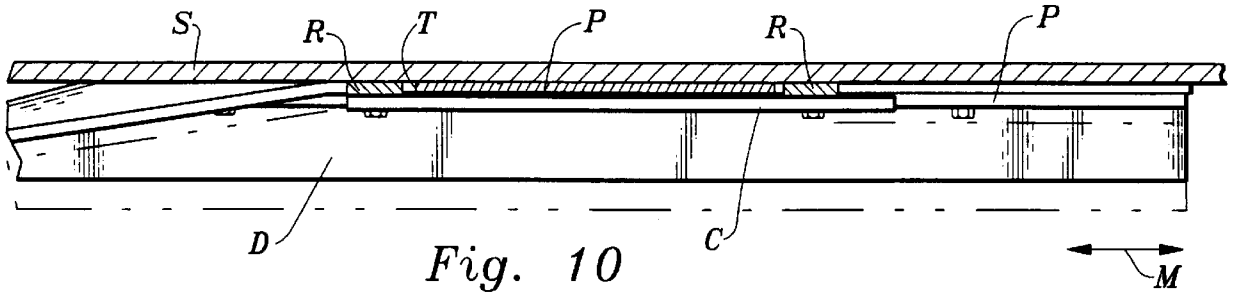
Fig. 10 (PRIOR ART)
FIG. 10 is a top view of a portion of that which is shown in FIG. 2.

As can be seen from a careful review of FIGS. 2, 6 and 10, prior art skid plates P are not allowed to move laterally, in a direction horizontal and perpendicular to vehicle motion (arrow M) to any extent. While every material has at least a small degree of elasticity, the skid plate P is typically made from a rigid material such as steel and has only a limited amount of elasticity. Hence, when the skid plate P is caused to deflect laterally because an object has been impacted, a substantial likelihood exists that the skid plate P, track T, cover plate C or some combination thereof will experience permanent deformation and damage. Such lateral forces (along arrow N of FIG. 4) can be caused by the skid plate P impacting a curb at a side of a roadway, a manhole, a speed bump, a storm drain grate, a pot hole or other obstacle found in the roadway over which the sweeper S is traveling.

This invention provides, a kit and method for attachment of the skid plate 10 to the track T and between the rails R of the sweeper S in a manner which allows for resilient displacement of the skid plate 10 away from the track T without permanent deformation of the skid plate 10 or other associated structures. The prior art cover plate C (FIG. 2) is removed and the portions of the kit of this invention are added.

With particular reference to FIGS. 3–5 and 7, details of the skid plate 10 of this invention and the elements of the kit of this invention are described. While each sweeper S is configured with two skid plates 10, the details of the skid plates 10 and other portions of the kit of this invention are merely described with respect to one of the two sides of the sweeper S, it being understood that for maximum benefit, both sides of the sweeper S would be similarly modified. The skid plate 10 is preferably a substantially planar structure of constant thickness between an outer surface 12 and an inner surface 14. The skid plate 10 includes a vertical leg 16 having a width between side edges 18 similar to a distance between the two rails R of the sweeper S. A lifting chain attachment point 20 is provided on the outer surface 12 near a base of the vertical leg 16 and near a geometric center of the entire skid plate 10. The chain attachment point 20 is attached to the lifting chain L for elevating and lowering the skid plate 10.

The skid plate to also includes a horizontal leg 22 below the vertical leg 16. The horizontal leg 22 is longer between a leading edge 24 and a trailing edge 26 than a width of the vertical leg 16 between the side edges 18. The horizontal leg 22 includes a lower edge 28 which is substantially horizontal. A series of drag shoe holes 29 are provided adjacent the lower edge 28 to which the drag shoe 30 can be attached.

While the skid plate 10 is substantially planar, a broom flange 27 is provided adjacent the trailing edge 26 of the horizontal leg 22 which extends diagonally away from the trailing edge 26 at approximately a 45° angle away from the plane in which other portions of the skid plate 10 are oriented. The broom flange 27 provides a surface for the bristles of the broom B to impact, preventing excessive wear of the bristles of the broom B at ends of the broom B.

The drag shoe 30 is attached to each skid plate 10 in a manner which prevents displacement of the drag shoe 30 away from the skid plate 10. The drag shoe 30 has a drag surface 32 which is adapted to be directly adjacent the surface upon which the sweeper S travels. The drag surface 32 is preferably hardened so that it can resist wear even when dragging on pavement and other rough surfaces. For instance, the drag shoe 30 can be formed from carbide steel and the drag surface 32 can be treated to further enhance its resistance to wear. An attachment surface 34 extends perpendicularly from the drag surface 32 and provides a surface for attachment of the drag shoe 30 to the drag shoe holes 29 adjacent the lower edge 28 of the skid plate 10. Attachment bolts 35 are utilized to secure the drag shoe 30 to the skid plate 10, so that the drag shoe 30 can be replaced should replacement be necessary.

The drag surface 32 of the drag shoe 30 is substantially planar and horizontal except that a forward rocker 36 and rear rocker 37 are provided such that the drag surface 32 curves upward at the ends thereof. The forward rocker 36 and rear rocker 37 allow the drag surface 32 to ride over small obstacles, such as minor irregularities in the surface over which the sweeper S is traveling.

While the forward rocker 36 and rear rocker 37 are sufficient for most minor irregularities in the surface, such as irregularities of one inch or less in height, some irregularities and obstacles are sufficiently elevated above the surface that they can catch on the forward rocker 36 as the sweeper S is traveling along the surface in the direction of vehicle motion M. To prevent such elevated objects from catching on the drag surface 32 and damaging the drag shoe 30 and skid plate 10, a ski nose 38 is provided on the forward rocker 36.

The ski nose 38 enhances the ability of the drag shoe 30 to ride over obstacles when the sweeper S is traveling forward in its typical mode of operation. Because prior art drag shoes D (FIGS. 2, 6 and 10) only have a forward rocker 36 and not the ski nose 38, the ski nose 38 can either be provided as an accessory separately attachable to the forward rocker 38 to extend the ability of the drag shoe 30 to ride over obstacles, or the ski nose 38 can be incorporated directly into the forward rocker 36. Thus, the drag shoe 30 including the ski nose 38 can be attached to the skid plate 10 (or prior art skid plate P) to provide the skid plate 10 and drag shoe 30 with the benefit provided by the ski nose 38. Preferably the ski nose 38 is at least four inches above the horizontal portion of the drag surface 32.

With continuing reference to FIGS. 3–5 and 7, details of the flex bar 40, forming a portion of the kit of this invention, are described. The flex bar 40 is a rigid construct having an elongate cylindrical arm 42 extending between a forward tab 44 and a rearward tab 46. Both of the tabs 44, 46 are preferably square and have a thickness similar to, but slightly less than, a diameter of the cylindrical arm 42. A length of the cylindrical arm 42 is sufficient to space the tabs 44, 46 apart by a distance similar to a distance between the two rails R of the sweeper S.

The forward tab 44 has a mount hole 45 passing there through which is not threaded. The rearward tab 46 has a tab hole 47 passing there through which is not threaded. The distance between the mount hole 45 and tab hole 47, center to center, is exactly the same as a distance between two lower rail holes 46 in the rails R of the sweeper S. The lower rail holes 56 are threaded. Preferably, the lower rail holes 56 are utilized in the prior art street sweeper S to secure the cover plate C to the rails R. Hence, when the kit of this invention is utilized and the cover plate C is removed from the sweeper S, the lower rail holes 56 are still utilized, but to hold the flex bar 40 in position rather than to hold the cover plate C in position.

One bar bolt 50 passes through each of the tabs 44, 46 and is threaded into each of the lower rail holes 56. A washer 52 and spring 54 are interposed between the heads of each bar bolt 50 and the tab 44, 46. Thus, the bar bolts 50 do not affix the tabs 44, 46 of the flexible bar 40 to the rails R. Rather, the tabs 44, 46 and flexible bar 40 attached thereto can move away from the rails R by compressing the springs 54. The springs 54 are of a compression spring type such that they can be compressed and then exert an outward force resisting such compression and tending to return the flex bar 40 back into position adjacent the rails R. The springs 54 thus cause the flexible bar 40 to be resiliently connected to the rails R of the sweeper S with the springs 54 providing a means for the flex bar 40 to flex away from the sweeper S and a means for the flex bar 40 to return back into position adjacent the sweeper S.

With particular reference to FIGS. 3–5 and 7, details of the retainer 60 are described. The retainer 60 works in conjunction with the flex bar 40 to provide a kit for resilient connection of the skid plate 10 to the sweeper S. It is understood that the retainer 60 could be utilized alone without the flex bar 40 or that the flex bar 40 could be used alone without the retainer 60. However, by utilizing the flex bar 40 and retainer 60, optimum resilient mounting of the skid plate 10 to the sweeper S is achieved.

The retainer 60 includes a rigid upper block 62 which is substantially tetragonal in form such that it has a square cross-section when cut in a horizontal plane and a rectangular cross-section when cut in any vertical plane. The upper block 62 is preferably substantially rigid and formed from rectangular stock, such as steel, with a hollow interior.

The upper block 62 includes an inside surface 64 parallel to and spaced from an outside surface 66. The inside surface 64 is adapted to be located directly adjacent the rail R which is most distant from the broom B. The outside surface 66 is spaced from the inside surface 64 by a thickness of the upper block 62, preferably about two inches. An upper bolt hole 68 passes through both the outside surface 66 and the inside surface 64 of the upper block 62. A lower bolt hole 69 passes entirely through the outside surface 66 and the inside surface 64 of the upper block 62 at a location below the upper bolt hole 68.

A reference plate 70 forms a portion of the retainer 60 attached to the outside surface 66 of the upper block 62 and extending down below the upper block 62 substantially vertically, from a top edge 72 down to a bottom edge 74. The reference plate 70 has an outer side 76 which is a most outward portion of the retainer 60 facing away from the sweeper S. An inner side 77 of the reference plate 70 faces the sweeper S and the upper block 62 of the retainer 60. A bottom bolt hole 75 passes through the reference plate 70 adjacent the bottom edge 74. The bottom bolt hole 75 is not threaded. The upper and lower bolt holes 68, 69 also pass through the reference plate 70, near the top edge 72.

A flex plate 80 is interposed between the reference plate 70 and the upper block 62 of the retainer 60. The flex plate 80 extends down below the upper block 62 a similar distance as the reference plate 70. The flex plate 80 includes a fixed end 82 sandwiched between the top edge 72 of the reference plate 70 and the outside surface 66 of the upper block 62. The flex plate 80 also includes a free end 84 opposite the fixed end 82 and spaced a similar distance from the upper block 62 as the bottom edge 74 of the reference plate 70.

While the reference plate 70 is planar and substantially rigid, the flex plate 80 includes a top bend 83 and a bottom bend 85 and is formed in a manner so that it exhibits a greater amount of flexibility than the reference plate 70. Preferably, both the reference plate 70 and flex plate 80 are both formed from a common material, such as high strength steel. However, the flex plate 80 is provided with a lesser thickness than the reference plate 70 so that a lesser amount of force is required to cause the flex plate 80 to flex than to cause the reference plate 70 to flex. In addition, the top bend 83 and bottom bend 85 provide regions where the flex plate 80 exhibits less strength than other portions of the flex plate 80, so that additional flexing of the flex plate 80 can occur at the top bend 83 and bottom bend 85. The flex plate 80 thus itself acts as a resilient member along with the springs 54, 93, 98 connecting the skid plate 10 to the sweeper S.

The top bend 83 causes the flex plate 80 to bend at approximately a 30° angle away from the reference plate 70 and toward other portions of the sweeper S. The bottom bend 85 preferably causes the flex plate 80 to bend back to-an orientation substantially parallel to the reference plate 70. Preferably, the distance between the top bend 83 and bottom bend 85 is sufficient that the flex plate 80 is oriented within a plane including the inside surface 64 of the upper block 62 and the top bend 83 is oriented within the same plane as the outside surface 66 of the upper block 62.

A portion of the flex plate 80 below the bottom bend 85 is oriented substantially vertically, parallel to and spaced from the bottom edge 74 of the reference plate 70. This free end 84 of the flex plate 80 includes a bolt face 86 facing the reference plate 70 and a plate face 87 facing the skid plate 10. A flex bolt 90 is oriented passing through the bottom bolt hole 75 of the reference plate 70 and with a head 91 of the flex bolt 90 oriented adjacent the bolt face 86 of the flex plate 80. A washer 92 is oriented adjacent the head 91 and a spring 93 is interposed between the inner side 77 of the reference plate 70 and the washer 92. The head 91 of the flex bolt 90 can either be permanently attached to the bolt face 86 of the flex plate 80 or attached in a removable manner to the bolt face 86 of the flex plate 80.

An adjustment nut 94 is threaded onto the flex bolt 90 on a side of the reference plate 70 adjacent the outer side 76 of the reference plate 70. When the adjustment nut 94 is tightened and drawn toward the head 91 of the flex bolt 90, the spring 93 is compressed somewhat and the free end 84 of the flex plate 80 is drawn away from the skid plate 10 and toward the reference plate 70 somewhat. When the adjustment nut 94 is loosened, the spring 93 is allowed to relax and extend the free end 84 of the flex plate 80 away from the reference plate 70. The adjustment nut 94 thus allows for fine tuning of the retainer 60.

The upper block 62, top edge 72 and fixed end 82 are each securely attached together, such as by welding. However, the upper block 62, top edge 72 and fixed end 82 are not secured, without relative motion, to the rail R of the sweeper S. Rather, retainer bolts 95 are oriented passing through the upper bolt hole 68 and lower bolt hole 69 in a similar manner to the attachment of the flex bar 40 to the rails R of the sweeper S. Thus, each retainer bolt 95 has a head 96 with a washer 97 adjacent thereto and with a spring 98 interposed between the washer 97 and the outer side 76 of the reference plate 70. Two threaded retainer holes 99 are provided in the rail R for attachment of the retainer bolts 95 to the rail R. Preferably, these retainer holes 99 are formed in the rail R by drilling an appropriately sized hole and tapping that hole to match the threads of the retainer bolts 95.

Figure 3:
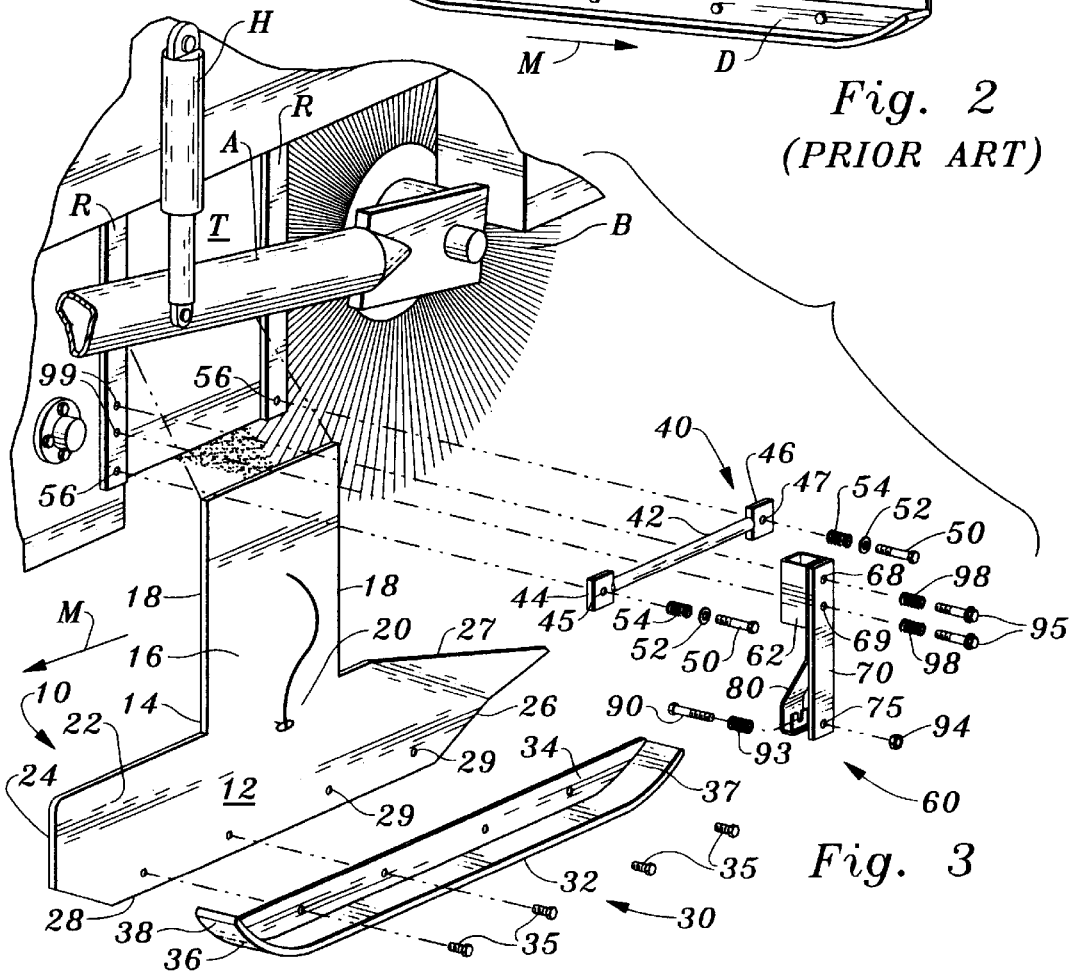
FIG. 3 is an exploded parts view of a left side of the sweeper with the kit of this invention installed thereon, illustrating how the kit is utilized to flexibly secure the skid plate to the sweeper.
Figure 4:
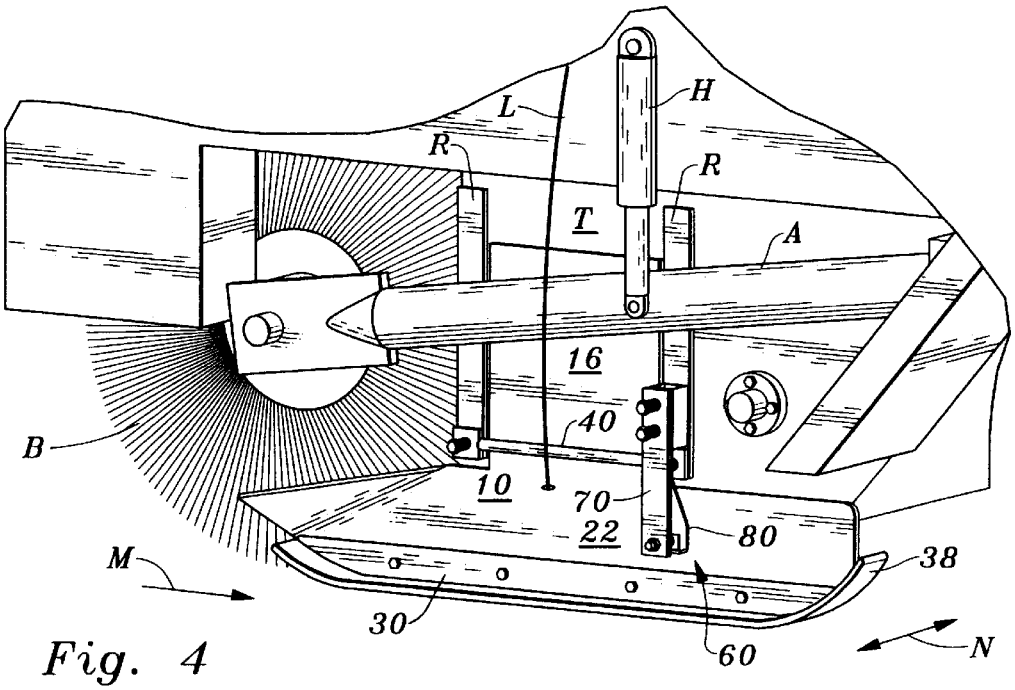
FIG. 4 is a perspective view of a portion of that which is shown in FIG. 1 showing details of how the kit of this invention is utilized to support the skid plate in position on the sweeper.
Figure 5:
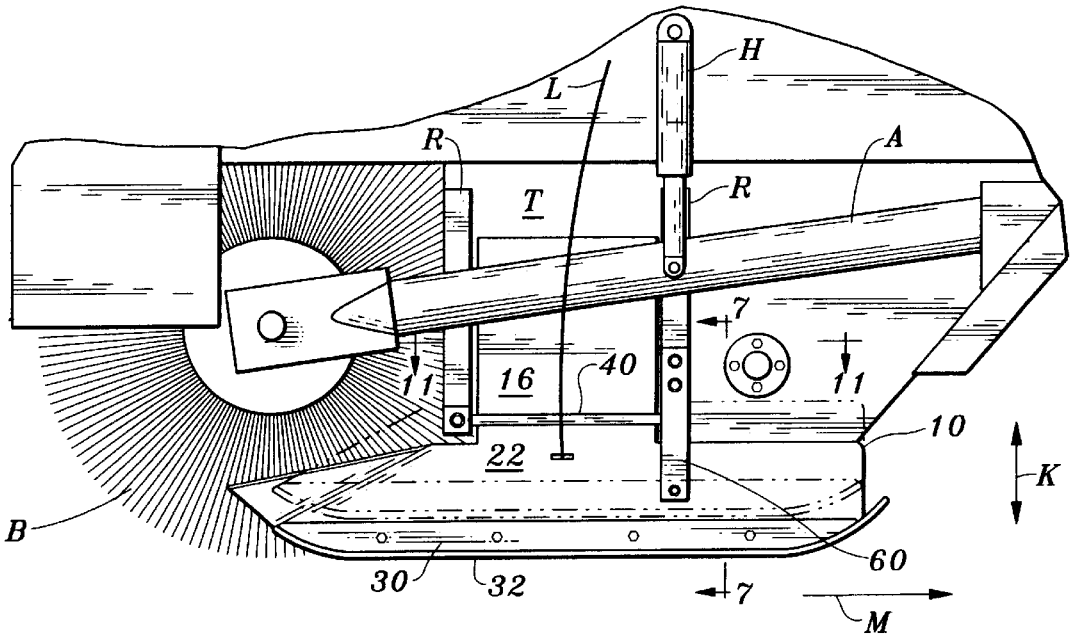
FIG. 5 is a right side view of a portion of that which is shown in FIG. 1 illustrating vertical displacement of the skid plate.
Figure 7:
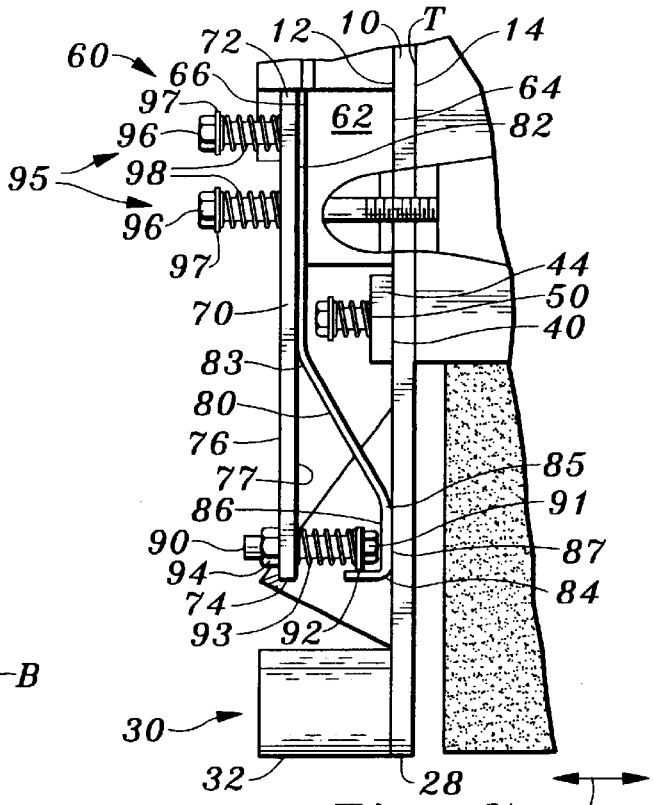
FIG. 7 is a sectional view taken along line 7—7 of FIG. 5.

In use and operation, and with particular reference to FIGS. 6–9, the kit of this invention provides resilient support for the skid plate 10 in the following manner. Before any lateral forces are encountered (FIG. 7), the skid plate 10 is oriented substantially vertically and adjacent the planar surface of the support track T. The flex bar 40 is positioned adjacent the outer surface 12 of the skid plate 10 with the tabs 44, 46 adjacent the rails R (FIG. 4). The bar bolts 50 hold the flex bar 40 in position by action of the springs 54 (FIG. 3). The retainer 60 is positioned with the upper block 62 adjacent one of the rails R (FIG. 4) and with the reference plate 70 extending vertically downward therefrom and with the flex plate 80 extending vertically downward therefrom except between the bends 83, 85. Should an operator of the sweeper S desire to raise or lower the skid plate 10, the lifting chain L (FIG. 5) is elevated, causing the skid plate 10 to be elevated along arrow K, or lowered by lowering the lifting chain L. Unless lateral forces are applied to this skid plate 10, such as by having the skid plate 10 impact an obstacle, the skid plate 10 will remain in position as shown in FIG. 7.

Many obstacles encountered by the skid plate 10 are encountered while the sweeper S is moving in a straight line and hence impact the forward rocker 36 or ski nose 38 of the drag shoe 30 first. Such obstacles encountered while the sweeper S is moving forward typically provide primarily only a vertical force upward on the skid plate 10. When such vertical forces are applied to the skid plate 10, the skid plate 10 can ride vertically upward and remain adjacent the surface of the support track T and between the rails R. Such vertical displacement of the skid plate 10 does not cause any lateral deflection of the skid plate 10.

Some obstacles encountered while the sweeper S is traveling in a straight line have oblique surfaces which are not perpendicular to the direction of vehicle motion. Such obstacles (i.e. railroad tracks which do not cross the roadway in a perpendicular direction) cause a lateral force to be imparted on the skid plate 10 even when the sweeper S is traveling in a straight line. Additionally, when the sweeper S is turning a corner, the skid plate 10 is caused to encounter obstacles in a manner which causes lateral forces to be imparted upon the skid plate 10 (i.e. curbs, speed bumps, storm drains, manholes, etc.). When such lateral forces are minor or only cause a slight amount of lateral displacement, the skid plate 10 can move away from other portions of the sweeper S because the skid plate 10 has some ability to flex slightly without exceeding the elastic limit of the material forming the skid plate 10 and permanently deforming the skid plate 10.

Figure 8:
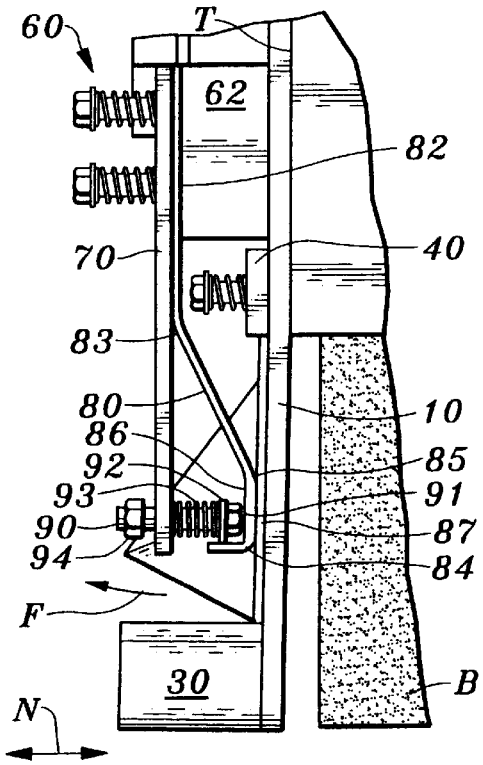
FIG. 8 is a sectional view similar to that which is shown in FIG. 7 but with a small amount of lateral forces applied to the skid plate, causing the retainer of this invention to absorb some of the lateral force encountered by the skid plate.

When such minor deformation occurs, the vertical leg 16 of the skid plate 10 can remain adjacent the surface of the support track T when the lower leg 22 of the skid plate 10 is deflected slightly away from other portions of the sweeper S in a lateral direction (along arrow F of FIG. 8). When such lesser lateral forces are encountered, the flex bar 40 remains substantially in its original position when no lateral forces (along arrow N) are provided. The horizontal leg 22 of the skid plate 10 is allowed to flex laterally slightly by the retainer 60.

Specifically, the outer surface 12 of the skid plate 10 is oriented adjacent the plate face 87 of the flex plate 80. When the skid plate 10 is deflected slightly away from the sweeper S, the skid plate 10 pushes against the plate face 87 of the flex plate 80, causing the flex bolt 90 to be displaced with respect to the reference plate 70 and causing the spring 93 to be compressed somewhat. The spring constant for the spring 93 is carefully selected so that the spring 93 provides only the flexibility necessary to allow the skid plate 10 to deflect a minor amount below that which would cause permanent deformation of the skid plate 10. The thickness, and hence the flexibility, of the flex plate 80 is also selected to provide desired flexibility to the kit. Additionally, the springs 54 holding the flex bar 40 in position are similarly matched with a spring constant which allows the springs 54 to begin to deform should forces be exerted on the skid plate 10 which exceed the elastic limit of the material forming the skid plate 10.

Figure 9:
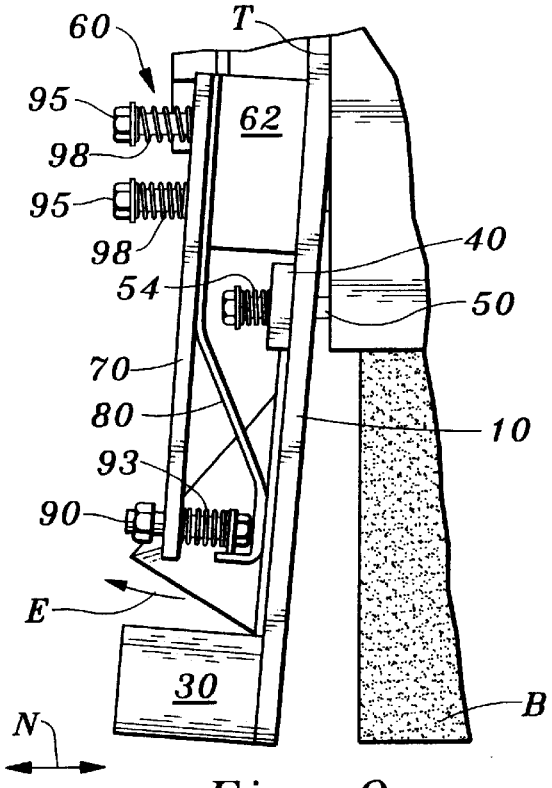
FIG. 9 is a sectional view of that which is shown in FIG. 7 but with a large amount of lateral force encountered by the skid plate and with the retainer and flex bar of this invention acting together to absorb lateral forces encountered by the skid plate.

When obstacles are encountered which exhibit sufficiently great lateral forces that mere minor elastic deflection of the skid plate 10 is not sufficient to absorb such forces, both the retainer 60 and flex bar 40 become active in allowing the skid plate 10 to flex away from other portions of the sweeper S without permanent damage to the skid plate 10 (FIG. 9). Specifically, when such lateral forces are provided, the retainer 60 itself pivots, along arrow E, and both the spring 93, and the springs 54 are compressed. Additionally, the springs 98 can be compressed somewhat to allow the upper block 62 of the retainer 60 to pivot slightly away from the rails R. In essence, because the springs 54, 93, 98 and flex plate 80 are being compressed, the skid plate 10 is not required to elastically flex as much as it would if the cover plate C of the prior art (FIG. 6) were utilized. The skid plate 10 is thus prevented from exceeding the elastic limit of the material forming the skid, plate 10 and can resiliently encounter the obstacle without damage. Once the lateral forces are released, the springs 54, 93, 98 and flex plate 80 exert a force which causes the flex bar 40 and retainer 60 to return to their original position, maintaining the skid plate 10 in its vertical orientation adjacent the surface of the support track T.

Figure 11:
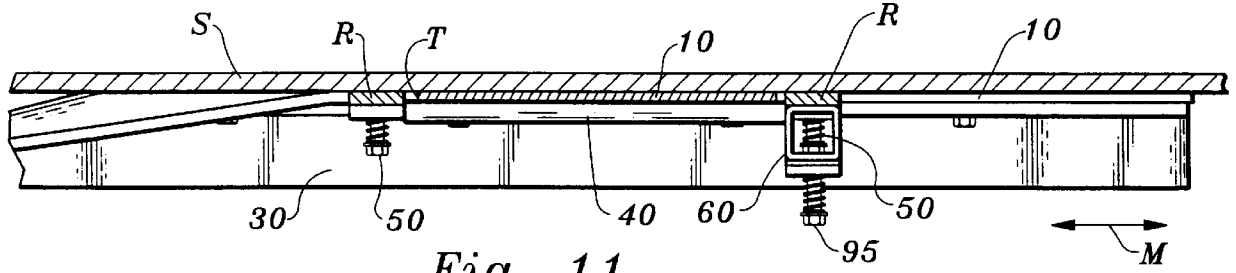
FIG. 11 is a sectional view taken along line 11—11 of FIG. 5.
Figure 12:
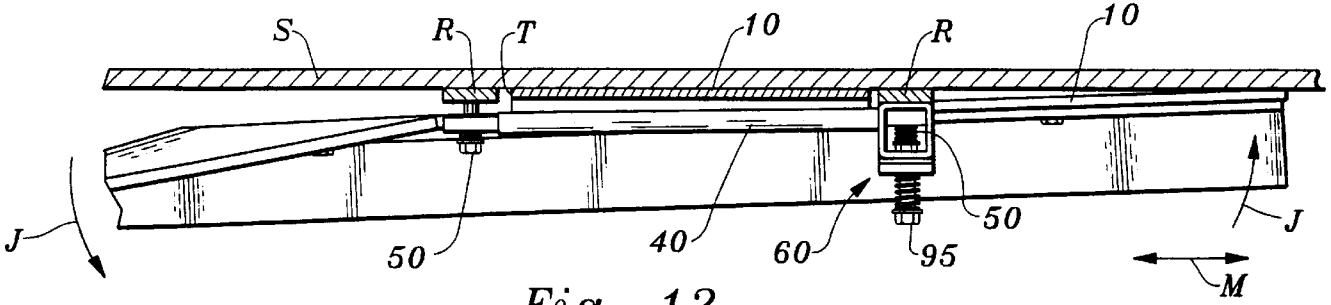
FIG. 12 is a sectional view similar to that which is shown in FIG. 11 illustrating how torsional flexing of the skid plate is facilitated by the retainer and flex bar of this invention.

FIG. 10 provides details from a vertical perspective of what happens when lateral forces are exerted on the prior art skid plate P and no resilient connection is provided. FIG. 11 provides the top view perspective of that which is shown in FIG. 7 further illustrating the relative locations of the flex bar 40 and retainer 60. FIG. 12 shows how lateral forces applied to the skid plate 10 do not need to be perfectly perpendicular to the direction of motion (arrow M) of the sweeper S, but rather can be skewed somewhat and the skid plate 10 can pivot in a somewhat rotating manner, along arrow J. Because the flex bar 40 is attached through two separate bar bolts 50 and springs 54, such torsional deflection of the skid plate 10 away from the sweeper S can be accommodated.

While the kit of this invention for attaching the skid plate 10 to the street sweeper S is provided with particular detail, it is understood that various different modifications to that which is described in detail above could be resorted to without departing from the scope of this invention. For instance, multiple retainers 60 could be provided or attached to different rails R. Multiple vertically displaced flex bars 40 could also be provided between the rails R. The springs 54, 93, 98 could be replaced with other resilient members so long as the desired characteristic of first absorbing lateral forces and then returning the skid plate 10 to its original position is provided.

What is claimed is:

1. A kit for resiliently coupling a skid plate to a street sweeper, to allow the skid plate to be displaced with respect to the street sweeper to which it is attached when a displacing load is experienced and return to its original position without permanent deformation of the skid plate or the sweeper when the displacing load subsides, the kit comprising in combination:

a skid plate having a substantially planar inner surface;

a street sweeper including a substantially planar track surface, said track surface and said inner surface of said skid plate oriented adjacent each other and adapted to slide relative to each other; and means to resiliently restrain said skid plate from moving away from said track surface, said restraining means interposed adjacent said skid plate and said sweeper, said restraining means including at least one resilient connector interfacing with said sweeper, said resilient connector including means to flex when loaded with said displacing load causing said skid plate to move away from said track surface, and said resilient connector including means to return said restraining means along with said skid plate to an original configuration adjacent said track surface when said displacing load ceases.

2. The kit of claim 1 wherein said track surface of said street sweeper is oriented in a vertical plane and is bounded on forward and rearward edges of said track surface by rails, said rails spaced apart by a distance at least as great as a width of said skid plate, said skid plate oriented between said rails and substantially parallel to said track surface.

3. The kit of claim 2 wherein said restraining means includes a bar with a forward end coupled through one of said at least resilient connectors to said forward rail and a rearward end coupled through one of said at least resilient connectors to said rearward rail, at least one of said resilient connector including means to allow said bar to resiliently flex away from said track surface and return back toward said track surface when said skid plate moves away from said track surface and abuts said bar.

4. The kit of claim 3 wherein at least one of said resilient connectors includes springs oriented adjacent said forward end of said bar and said rearward end of said bar, said springs configured to be loaded while allowing at least one of said ends of said bar to move away from an adjacent said rail when said skid plate moves away from said track surface and abuts said bar.

5. The kit of claim 1 wherein said restraining means includes a retainer having a first end coupled to said sweeper and a second end extending over said skid plate on a side of said skid plate opposite said inner surface, said second end of said retainer adjacent said skid plate, said retainer including means to flex relative to said street sweeper when said skid plate moves away from said track surface, and said retainer including means to return to an original position and relocate said skid plate adjacent said track surface when said displacing load ceases.

6. The kit of claim 5 wherein said first end of said retainer is resiliently coupled to said street sweeper with one of said at least one resilient connectors and said second end of said retainer includes means to flex with respect to said first end of said retainer.

7. The kit of claim 6 wherein said track surface of said street sweeper is oriented in a vertical plane and is bounded on forward and rearward edges of said track surface by rails, said rails spaced apart by a distance at least as great as a width of said skid plate, said skid plate oriented between said rails and substantially parallel to said track surface; and wherein said first end of said retainer is coupled to said sweeper through one of said rails with at least one spring located adjacent said upper end of said retainer, said spring configured to allow said upper end of said retainer to resiliently move relative to said rail of said sweeper when said skid plate moves away from said track surface under said displacing load and said spring including means to return said upper end of said retainer to an original position adjacent said rail of said sweeper when said displacing load ceases.

8. The kit of claim 6 wherein said track surface of said street sweeper is oriented in a vertical plane and is bounded on forward and rearward edges of said track surface by rails, said rails spaced apart by a distance at least as great as a width of said skid plate, said skid plate oriented between said rails and substantially parallel to said track surface; and wherein said second end of said retainer includes a flex plate and a reference plate, said reference plate formed from substantially rigid sheet material having a greater thickness than said flex plate, said flex plate formed from a similar material as said reference plate, said flex plate oriented closer to said skid plate than said reference plate.

9. The kit of claim 8 wherein said restraining means includes a bar extending between said forward rail and said rearward rail, each end of said bar resiliently coupled to one of said rails through one of said at least one resilient connectors.

10. The kit of claim 1 wherein a lowermost edge of said skit plate includes a substantially planar horizontally oriented drag shoe thereon, said drag shoe including a planar vertically oriented attachment surface removably attachable to said skid plate for attachment and replacement of said drag shoe, said drag shoe including a ski nose on a forward side of said drag shoe, said ski nose angling up to a location higher than said attachment surface.

11. A street sweeper featuring resilient skid plates, comprising in combination:

at least one skid plate having a substantially planar inner surface;

at least one substantially planar track surface, said track surface and said inner surface of said skid plate oriented parallel and adjacent to each other; and means to resiliently restrain said skid plate from moving away from said track surface, said restraining means interposed adjacent said skid plate and said sweeper, said restraining means including at least one resilient connector connecting said restraining means to said sweeper, said resilient connector including means to flex when loaded with said displacing load causing said skid plate to move away from said track surface, and said resilient connector including means to return said restraining means along with said skid plate to an original configuration when said displacing load ceases.

12. The sweeper of claim 11 wherein said restraining means includes at least one retainer having a first end coupled to said sweeper and a second end overlying said skid plate, said second end including means to flex away from said sweeper when said skid plate moves away from said track surface of said sweeper and impacts said second end of said retainer, said second end of said retainer including means to return said skid plate to a position adjacent said track surface when forces causing said skid plate to be displaced away from said track surface subside.

13. The sweeper of claim 12 wherein said flexing means of said second end of said retainer includes a flex plate having a fixed end attached to said first end of said retainer and a free end opposite said fixed end, said flex plate formed from a sufficiently resilient material that said flex plate can flex along with said skid plate away from said track surface and resiliently push back against said skid plate to return said skid plate to an original position adjacent said track surface when said forces displacing said skid plate away from said track surface subside.

14. The sweeper of claim 13 wherein said second end of said retainer includes a reference plate having a top edge coupled to said first end of said retainer and a bottom edge opposite said top edge, said reference plate having sufficient rigidity to remain in fixed position relative to said first end of said retainer at all times, said bottom edge of said reference plate resiliently coupled to said free end of said flex plate such that said flex plate can move relative to said reference plate when said skid plate moves away from said track surface, and means to adjust a position of said free end of said flex plate relative to said bottom edge of said reference plate.

15. The sweeper of claim 14 wherein said first end of said retainer is attached to said sweeper with bolts, said bolts having springs surrounding said bolts and oriented between heads of said bolts and said first end of said retainer, such that said first end of said retainer can compress said springs and move away from said sweeper somewhat, whereby loads exceeding an elastic limit of said flex plate can cause said retainer to rotate with said first end of said retainer moving away from said sweeper and still return said skid plate to an original position adjacent said track surface when forces causing displacement of said skid plate subside, said springs having a sufficiently rigid character to not be compressed until after said flex plate has begun to flex.

* * * * *